US012104596B2

(12) United States Patent
Dunn

(10) Patent No.: US 12,104,596 B2
(45) Date of Patent: Oct. 1, 2024

(54) HELIUM COMPRESSOR SYSTEM WITH UNMODIFIED SCROLL COMPRESSOR

(71) Applicant: SUMITOMO (SHI) CRYOGENICS OF AMERICA, INC., Allentown, PA (US)

(72) Inventor: Stephen Brown Dunn, Bethlehem, PA (US)

(73) Assignee: SUMITOMO (SHI) CRYOGENICS OF AMERICA, INC., Allentown, PA (US)

( * ) Notice: Subject to any disclaimer, the term of this patent is extended or adjusted under 35 U.S.C. 154(b) by 201 days.

(21) Appl. No.: 17/624,928

(22) PCT Filed: Jul. 23, 2020

(86) PCT No.: PCT/US2020/043193
§ 371 (c)(1),
(2) Date: Jan. 5, 2022

(87) PCT Pub. No.: WO2021/025868
PCT Pub. Date: Feb. 11, 2021

(65) Prior Publication Data

US 2022/0290670 A1 Sep. 15, 2022

Related U.S. Application Data

(60) Provisional application No. 62/883,873, filed on Aug. 7, 2019.

(51) Int. Cl.
*F04C 23/00* (2006.01)
*F04C 18/02* (2006.01)
*F04C 29/02* (2006.01)

(52) U.S. Cl.
CPC ..... *F04C 23/008* (2013.01); *F04C 18/0215* (2013.01); *F04C 29/026* (2013.01);
(Continued)

(58) Field of Classification Search
CPC ..... F04C 29/042; F04C 29/026; F04C 2240/809; F04C 2250/102; F04C 29/025;
(Continued)

(56) References Cited

U.S. PATENT DOCUMENTS 4,648,814 A 3/1987 Shiibayashi
5,640,854 A 6/1997 Fogt et al.
(Continued)

FOREIGN PATENT DOCUMENTS

CN 101063450 A 10/2007
CN 102052282 A 5/2011
(Continued)

OTHER PUBLICATIONS

International Preliminary Report on Patentability dated Feb. 17, 2022, from the corresponding International Application No. PCT/US2020/043193.
(Continued)

*Primary Examiner* — Anthony Ayala Delgado
(74) *Attorney, Agent, or Firm* — KATTEN MUCHIN ROSENMAN LLP

(57) ABSTRACT

The disclosed invention provides an unmodified scroll compressor with enhanced oil management system that enables the compressor system to compress helium. The compressor system includes a standard scroll compressor, oil separator, and an adsorber. The compressor includes a housing containing an orbiting scroll and a stationary scroll, a motor, and an oil sump in a bottom of the housing. The stationary scroll has one or more injection ports, and the housing contains a single discharge port, a return port, and a single injection port connected to the injection ports of the stationary scroll. The oil separator receives a mixture of helium and oil from the discharge port. The compressor system further includes a line bringing a first fraction of oil from the oil separator to
(Continued)

the injection port, one or more lines bringing a second fraction of oil to the return port along with helium. The adsorber retains a third fraction of oil.

20 Claims, 2 Drawing Sheets

(52) U.S. Cl.
CPC .... *F04C 2210/105* (2013.01); *F04C 2220/22* (2013.01); *F04C 2240/60* (2013.01); *F04C 2240/809* (2013.01)

(58) Field of Classification Search
CPC ..... F04C 2210/105; F04C 18/0215; F04C 29/12; F04C 29/028; F04C 29/023; F04C 2240/806
See application file for complete search history.

(56) References Cited

U.S. PATENT DOCUMENTS

| | | | | |
|---|---|---|---|---|
| 5,660,539 | A | 8/1997 | Matsunaga et al. | |
| 6,082,981 | A | 7/2000 | Nakajima et al. | |
| 6,488,120 | B1 | 12/2002 | Longsworth | |
| 6,615,598 | B1 | 9/2003 | Wang et al. | |
| 7,674,099 | B2 | 3/2010 | Dunn | |
| 8,303,278 | B2 | 11/2012 | Roof et al. | |
| 8,628,306 | B2 | 1/2014 | Shiibayashi et al. | |
| 8,769,982 | B2 | 7/2014 | Ignatiev et al. | |
| 8,888,476 | B2 | 11/2014 | Hasegawa et al. | |
| 8,956,131 | B2 | 2/2015 | Nakamura et al. | |
| 8,978,400 | B2 | 3/2015 | Dunn et al. | |
| 9,353,751 | B2 | 5/2016 | Shiibayashi et al. | |
| 2005/0268641 | A1 | 12/2005 | Dekiya | |
| 2007/0253854 | A1 | 11/2007 | Dunn | |
| 2009/0180910 | A1* | 7/2009 | Shiibayashi ..... | F04C 29/026 418/55.1 |
| 2011/0107790 | A1* | 5/2011 | Dunn ..... | F04B 39/06 62/507 |
| 2017/0175743 | A1 | 6/2017 | Dunn et al. | |
| 2017/0176070 | A1* | 6/2017 | Sloan ..... | F25B 9/002 |

FOREIGN PATENT DOCUMENTS

| | | | |
|---|---|---|---|
| CN | 108474370 | A | 8/2018 |
| EP | 1197712 | A2 | 4/2002 |
| EP | 1965157 | A2 | 9/2008 |
| JP | S59-93616 | U | 6/1984 |
| JP | H04-12187 | A | 1/1992 |
| JP | H04-325793 | A | 11/1992 |
| JP | H05-026183 | A | 2/1993 |
| JP | H05-288170 | A | 11/1993 |
| JP | H07-119638 | A | 5/1995 |
| JP | H10-231791 | A | 9/1998 |
| JP | 2000-283069 | A | 10/2000 |
| JP | 2007-298029 | A | 11/2007 |
| JP | 2008-019857 | A | 1/2008 |

OTHER PUBLICATIONS

Japanese Office Action dated Feb. 21, 2023, for the Corresponding Japanese Patent Application No. 2022-503868.
Chinese Office Action dated Mar. 31, 2023, for the Corresponding Chinese Patent Application No. 202080053866.2.
International Search Report and Written Opinion mailed Oct. 20, 2020, from PCT/US2020/043193, 10 sheets.
Second Office Action issued Dec. 29, 2023, from Chinese Application No. 202080053866.2, 7 sheets including English translation.
The Extended European Search Report dated Jan. 26, 2024, from European Patent Application No. 20849211.6, 8 sheets.
Notification to Grant a Patent Right issued Mar. 29, 2024, from Chinese Application No. 202080053866.2, 9 sheets including English translation.

* cited by examiner

HELIUM COMPRESSOR SYSTEM WITH UNMODIFIED SCROLL COMPRESSOR

CROSS REFERENCE TO RELATED APPLICATIONS

This application is the National Stage of International Application No. PCT/US2020/043193, filed on Jul. 23, 2020, which claims priority of U.S. Provisional Patent Application No. 62/883,873, filed on Aug. 7, 2019, which are incorporated herein by reference in its entirety.

BACKGROUND

Cryogenic refrigerators operating on the Gifford McMahon (GM) cycle have dominated the small cryogenic refrigerator market in part because they use oil lubricated compressors that are modified versions of those produced for air conditioning and food storage applications. They are very reliable and benefit from the costs associated with mass production. Cryogenic refrigerators use helium as a refrigerant while the standard compressors are designed to compress standard refrigerants which have specific heat ratios that are low relative to that of helium. The temperature increase in helium during compression is much greater than that of standard refrigerants. The best way to keep the helium within a reasonable temperature limit is to flow some of the compressor oil, which is used to lubricate bearings in the compressor, along with the helium as it is being compressed. Scroll type compressors are well suited to do this because they can tolerate having more than enough oil to flow with the helium through the scrolls to keep the helium cool, and they do not have inlet or outlet valves that might fail. Another aspect of using oil lubricated compressors to compress helium for GM expanders is that the oil has to be removed from the helium before reaching the expander. The last phase of this process is to remove residual oil in an adsorber. Adapting an unmodified standard oil lubricated air conditioning compressor to compressing helium requires an external oil management system that controls the recirculation of lubricating oil and cooling oil that flow with the helium through the discharge port. In addition, an oil reservoir is needed that can be depleted as some of the oil is transferred to the adsorber. Descriptions of present oil management systems for compressing helium are as follow.

U.S. Pat. No. 6,488,120 ("the '120 patent") titled "Fail-safe Oil Lubricated Helium Compressor" describes the process of transferring oil from the compressor sump to the adsorber and controlling the initial amount of oil in the system so that the compressor seizes for lack of lubricating oil before the adsorber is more that 75% loaded. This system is typically designed to run at least ten years before it fails. As shown in the '120 patent, it is typical to have most of the oil that cools the helium during compression flow out from the compressor through a port in the compressor sump then through an oil cooler. Helium, along with some entrained oil, leaves through a discharge port, is cooled, and then the entrained oil is separated from the helium in an oil separator. The compressor depicted in the '120 patent is a rolling piston type that has the return helium with both the oil from the sump and the oil from the oil separator flow directly into the rolling piston intake and discharge into the compressor housing through a port that has a valve. Both the port for oil in the compressor sump and the valve are non-standard adaptations to the compressor so that it can compress helium.

Most scroll compressors are designed to operate vertically. One of the scrolls is typically stationary in the upper part of the compressor housing. The mating scroll is connected to the end of a motor driven shaft with a mechanism that causes it to orbit in the stationary scroll. Gas entering the outer volutes is compressed as it spirals toward the center where it is discharged. Oil collects in the sump and is pumped through the shaft to lubricate the bearings. Some compressor designs allow the stationary scroll to move axially a small amount to control the seal gap with the orbiting scroll or to relieve excess pressure.

The simplest standard scroll compressors designed for air condition service have only one discharge port and one return port and are available in two basic types. The first type has the return gas at a return (or low) pressure flow into the section of the compressor housing with the motor and oil sump. Gas mixed with entrained oil flows out through a discharge port at a discharge (or high) pressure. U.S. Pat. No. 6,615,598 ("the '598 patent") titled "Scroll Machine with Liquid Injection" describes this first type of scroll compressor in which liquid refrigerant returns through the same port as the gaseous refrigerant. The second type has the return gas at low pressure flow through a port in the compressor housing and directly into the scroll, then discharge into the section of the housing with the motor and oil sump which are thus at high pressure. Gas mixed with a small amount of oil flows out through a discharge port in the housing at a location above the oil sump at a discharge (or high) pressure. U.S. Pat. No. 5,660,539 ("the '539 patent") titled "Scroll Compressor" describes this type of scroll compressor. Standard air conditioning and refrigeration systems can tolerate a small amount of oil circulating with the refrigerant and the amount of oil in the system is constant. U.S. Pat. No. 8,888,476 ("the '476 patent") titled "Horizontal Scroll Compressor" describes a compressor similar to the '539 patent except that it is oriented horizontally.

The '598 patent describes returning a small amount of liquid refrigerant to the compressor along with the return gas as a means to cool the gas before it enters the scroll. Other standard scroll compressors are available with separate ports in the housing that introduce liquid or vapor refrigerant to one or more ports in the stationary scroll to increase the efficiency of the system. Examples of compressors with one or more liquid injection ports in the stationary scroll and with the motor and oil sump at low pressure are found in U.S. Pat. No. 5,640,854 ("the '854 patent") titled "Scroll Machine with Liquid Injection", U.S. Pat. No. 8,303,278 ("the '278 patent") titled "Scroll Compressor with Liquid/Vapor Injection", and U.S. Pat. No. 8,769,982 ("the '982 patent") titled "Injection System." U.S. Pat. No. 8,956,131 ("the '131 patent") titled "Scroll Compressor" describes an injection port in the stationary scroll in a compressor with the motor and oil sump at high pressure. These compressors that have one discharge port, one return port, and one port in the housing for liquid injection are described herein as "unmodified standard scroll compressors."

U.S. Pat. No. 8,978,400 ("the '400 patent") titled "Air Cooled Helium Compressor" describes a compressor system with a scroll compressor that has been modified by adding a port in the oil sump. Oil at high pressure flows from the sump through the port to an oil cooler before returning to an injector port in the scroll. Helium flows through a separate port in the housing and through a separate cooler before returning through a port to the inlet of the scroll. Approximately 70% of the heat of compression is removed from the oil and the balance is removed from the helium in the after-coolers. The oil that flows with the helium through the scrolls occupies about 2% of the displaced volume. The scroll compressor described in the '400 patent has features described in U.S. Pat. No. 4,648,814 ("the '814 patent") titled "Scroll Machine with Oil Injection", U.S. Pat. No. 8,628,306 ("the '306 patent") titled "Helium Enclosed Compressor", and, U.S. Pat. No. 53,751 ("the '751 patent") titled "Sealed Scroll Compressor for Helium." These all have the oil sump at high pressure, a port for oil to flow out of the sump, and a port to inject oil at a midpoint in the scroll.

An example of a horizontal scroll compressor that has been modified to compress helium is found in U.S. Pat. No. 7,674,099 ("the '099 patent") titled "Compressor with Oil By-pass." This compressor is the type with the housing at low pressure and the oil in the sump flows directly into the scroll with the helium and then flows out the discharge port with the helium into an external oil separator. The modification to the standard compressor is a port in the housing that brings oil from the bottom of the separator to a point where it sprays oil on the end of the drive shaft to lubricate the bearings.

Helium is the most common gas that requires special features in compressors designed for standard refrigerants but it is used in the disclosed invention to represent all monatomic and diatomic gases that get hotter than the standard refrigerants when they are compressed.

SUMMARY

Embodiments of the helium compressor system with unmodified scroll compressor of the disclosed invention have an enhanced oil management system that enables some unmodified mass produced scroll compressors, which may be designed for air conditioning or food storage applications, to be used for compressing helium. The unmodified standard scroll compressors that are suitable for this application have a housing containing one discharge port, one return port, and one port in the housing for liquid injection.

The suitable compressors include a scroll comprising an orbiting scrool and a stationary scroll where the stationary scroll has one or more injection ports located between the inlet and outlet, a discharge port in the housing through which a mixture of helium and oil at high pressure are discharged. The compressor further includes at least one return port in the housing which receives helium at low pressure, an injection port in the housing connected to the one or more injection ports of the stationary scroll, a motor that has a drive shaft that drives the orbiting scroll, and a compressor oil sump located in a bottom of the housing.

The oil management system coupled to the unmodified standard scroll compressor brings a mixture of helium and oil from the discharge port into an external separator from which a first fraction is returned to the compressor through the injection port and a second fraction is returned with the helium through the return port. A third fraction is trapped in an adsorber over a period of years. The oil that collects in the adsorber comes from the depletion of oil in an oil sump that is either in the compressor or the external oil separator.

The compressor system of this invention is designed primarily to supply compressed helium to one or more cryogenic expanders.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTIONS

Figure 1:
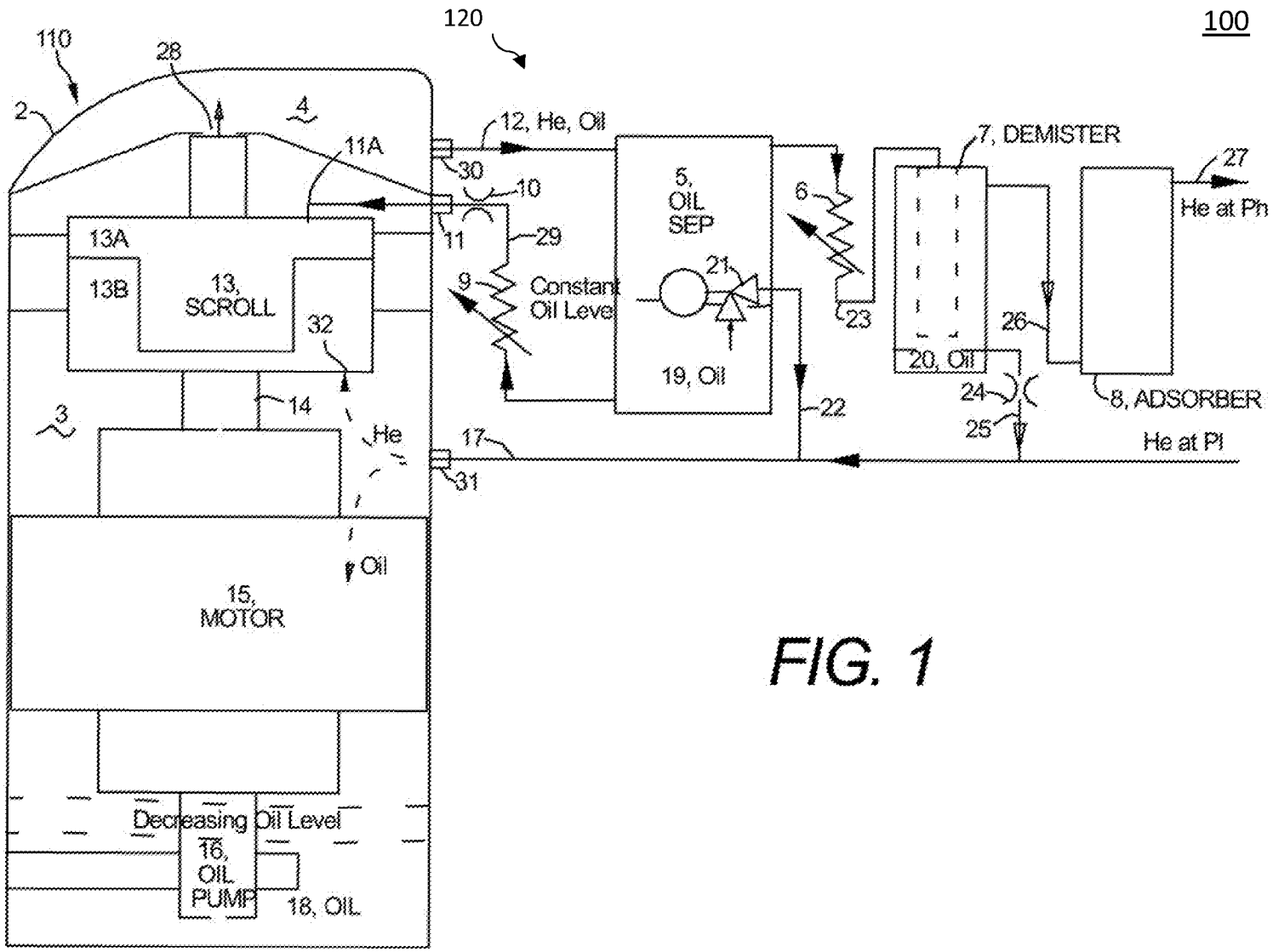
FIG. 1 is a schematic diagram of an embodiment of the scroll compressor system in which helium returning at low pressure flows into a low pressure section of the housing that contains the motor and oil sump.

In this section, some embodiments of the invention will be described more fully with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments. Parts that are the same or similar in the drawings have the same numbers and descriptions are usually not repeated.

With reference to FIG. 1, shown is a schematic diagram of an embodiment of oil-lubricated helium compressor system 100 in which helium returning at low pressure flows into a low pressure section of the housing 2 that contains the motor and oil sump. The compressor system 100 includes a compressor 110 and an oil management system 120 coupled to the compressor 110. The oil management system 120 includes bulk oil separator 5, demister 7, adsorber 8, and lines 12, 17, 22, 23, 25, 26, and 29. The compressor 110 includes a compressor housing 2 which contains scroll 13, motor 15, drive shaft 14, oil sump 18, oil pump 16. A low pressure section 3 is formed below the scroll 13, and a high pressure section 4 is formed above the scroll 13. Helium at low pressure returns through one or more return lines 17 and is supplied into the housing 2 through at least one return port 31. The helium at low pressure may be mixed with oil returning from bulk oil separator 5 and demister 7. As the helium enters into low pressure section 3 of the compressor 110, most of the oil falls to oil sump 18 at the bottom of the housing 2, and the helium along with some oil mist flows into scroll 13 through an inlet 32 of the scroll 13. The scroll 13 includes an inlet 32 that receives the helium at low pressure supplied through the return port 31, and an outlet 28 that discharges compressed helium at high pressure to the high pressure section 4 above the scroll 13. The return port 31 may be connected to the low pressure section 3. The return port 31 may be located between the scroll 13 and the oil sump 18. Oil that lubricates the bearings in the compressor 110 is pumped up through drive shaft 14. Some of the lubricating oil and the oil that is injected into the scroll 13 is compressed along with the helium in the scroll 13. A mixture of the helium at high pressure and oil is discharged through an outlet 28 of the scroll 13 into high pressure section 4 of the compressor 110. From the high pressure section 4, the mixture of helium at high pressure and oil flows through discharge port 30 and the line 12 into bulk oil separator 5.

The scroll 13 includes a stationary scroll 13A and orbiting scroll 13B. The stationary scroll 13A may be located in the upper part of the compressor housing 2. The orbiting scroll 13B may be connected to the end of a motor driven shaft 14 with a mechanism that causes the orbiting scroll 13B to orbit in the stationary scroll 13A. Gas entering the outer volutes is compressed as it spirals toward the center where it is discharged. Oil collects in the oil sump 18 and is pumped through the drive shaft 14 to lubricate the bearings or other mechanical parts in the compressor 110. The stationary scroll 13A has one or more injection ports 11A that are connected to the injection port 11 of the housing 2. The one or more injection ports 11A of the scroll 13 may be located between the inlet 32 and outlet 28 of the scroll 13.

The oil in the mixture of helium and oil may be separated in the bulk oil separator 5, and the oil may flow to the sump 19 formed in the bottom of the bulk oil separator 5. A fraction of oil in the sump 19 of bulk oil separator 5 returns to oil injection port 11 through oil cooler 9 and line 29. This oil is referred to as cooling oil since about 70% of the heat of compression is taken out in oil cooler 9. The cooling oil circulation rate is controlled by orifice 10 formed on the line 29. The cooling oil is supplied to the scroll 13 through one or more injection ports 11A of the stationary scroll 13A which is connected to the injection port 11 of the housing 2. The cooling oil supplied from the injection ports 11A and lubricating oil supplied through the shaft 14 may be mixed in the scroll 13, and may be discharged to the high pressure section 4 through the outlet 28 together with compressed helium at high pressure.

Meanwhile, another fraction of the oil separated in the bulk oil separator 5 may flow to line 22 through a float valve 21 that may be formed in the bulk oil separator 5. The line 22 is connected to the one or more return lines 17 though which helium at low pressure from an cryogenic expander (not shown) returns to the housing 2. This fraction of the oil may be mixed with the returning helium in the one or more lines 17, and returns to oil sump 18 through the return port 31. The float valve 21 enables the bulk oil separator 5 to maintain a constant level of oil in bulk oil separator 5.

Helium and some entrained oil flow from bulk oil separator 5 through helium cooler 6 and line 23 into demister 7. Oil separated from the mixture of helium and oil collects in sump 20 in the demister 7, and is then returned to compressor sump 18 through orifice 24, line 25, and return lines 17. A very small amount of oil flows with the helium from demister 7 through line 26 into adsorber 8 where the oil is retained. Oil free helium at high pressure then flows from adsorber 8 through line 27 to a cryogenic expander (not shown). As oil collects in adsorber 8 over a period of years, the oil level in compressor sump 18 drops.

A first fraction of oil in the oil separator 5 returns to the injection ports 11A of the stationary scroll 13A through the line 29 from the bottom of the oil separator 5. A second fraction of oil may include oil in the oil separator 5 that returns to the return port 31 through the lines 17 and 22, and oil in the demister 7 that returns to the return port 31 through lines 17 and 25. A third fraction of oil may be retained in the adsorber 8. In the embodiment shown in FIG. 1, the oil level in the oil separator 5 is maintained at a constant level, and the oil level in the compressor sump 18 is depleted as the third fraction of oil is retained in the adsorber 8. The floating valve 21 may enable the oil separator 5 to maintain a constant oil level.

Figure 2:
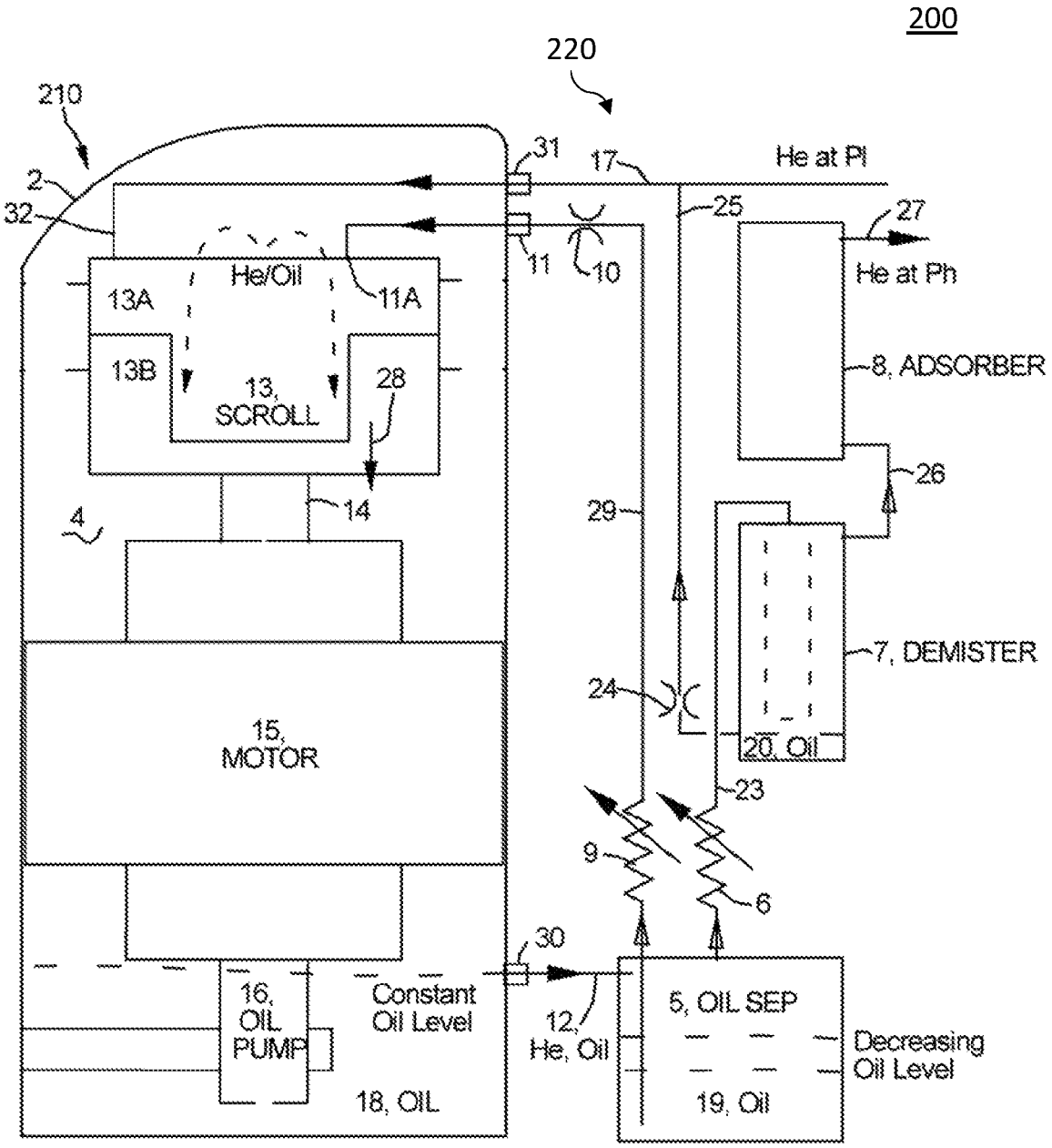
FIG. 2 is a schematic diagram of another embodiment of the scroll compressor system in which the helium returning at low pressure flows directly into the scroll placed inside the housing, and then is discharged into the high pressure section of the housing that contains the motor and oil sump.

With reference to FIG. 2, shown is a schematic diagram of another embodiment of oil-lubricated helium compressor system 200. The compressor system 200 includes a compressor 210 and an oil management system 220 coupled to the compressor 210. The oil management system 220 incudes bulk oil separator 5, demister 7, adsorber 8, and lines 12, 17, 23, 25, 26 and 29. The compressor 210 includes a compressor housing 2 which contains scroll 13, motor 15, drive shaft 14, oil sump 18, and oil pump 16. A high pressure section 4 is formed inside the housing 2. Helium at low pressure returns from a cryogenic expander (not shown) through line 17 and at least one return port 31. The helium at low pressure may be mixed in the return line 17 with oil returning from demister 7. The scroll 13 has an inlet 32 that is connected to the return port 31 and receives the helium at low pressure and returning oil. The helium at low pressure is compressed in the scroll 13. Helium along with the oil from demister 7 flows directly into scroll 13 through the inlet 32. Oil that lubricates the bearings in the compressor 210 is pumped up through shaft 14. Some of the lubricating oil, oil from demister 7, and oil that is injected into the scroll 13 through injection ports 11 and 11A are compressed along with the helium, and are discharged through outlet 28 of the scroll 13 into high pressure section 4 of the compressor 210. In the high pressure section 4, most of the oil separates from the helium and collects in compressor sump 18.

FIG. 2 shows discharge port 30 below the motor 15. The discharge port 30 is located in a bottom portion of the housing 2 below the scroll 13. The discharge port 30 may be located between the scroll 13 and the oil sump 18. The oil level in sump 18 may be maintained at substantially the same level as the discharge port 30 such that oil may flow out with the helium through line 12 to bulk oil separator 5. From this point, the oil management processes are the same as those of the embodiment shown in FIG. 1 except that the oil that collects in adsorber 8 comes from oil sump 19 in bulk oil separator 5 rather than oil sump 18 in the compressor 210.

The oil in the mixture of helium and oil may be separated in the bulk oil separator 5, and the oil may flow to the sump 19 formed in the bottom of the bulk oil separator 5. A fraction of oil in the sump 19 of bulk oil separator 5 returns to oil injection port 11 through oil cooler 9 and line 29. This oil is referred to as cooling oil since about 70% of the heat of compression is taken out in oil cooler 9. The cooling oil circulation rate is controlled by orifice 10 formed on the line 29. The cooling oil is supplied to the scroll 13 through one or more injection ports 11A of the stationary scroll 13A. The cooling oil supplied from the injection ports 11A, the lubricating oil supplied through the shaft 14, and the oil returning from the demister 7 through the return lines 17 may be mixed in the scroll 13, and may be discharged to the high pressure section 4 through the outlet 28 together with compressed helium at high pressure.

Another fraction of the oil separated in the bulk oil separator 5 may flow to line 23 to demister 7 through helium cooler 6. Separated oil in the demister 7 collects in sump 20, and is then returned to compressor sump 18 through orifice 24, line 29, and return line 17. A very small amount of oil flows with the helium from demister 7 through line 26 into adsorber 8 where the oil is retained. Oil free helium at high pressure then flows from adsorber 8 through line 27 to a cryogenic expander (not shown). As oil collects in adsorber 8 over a period of years, the oil level in the bulk oil separator 5 drops while the oil level in the sump 18 of the compressor 210 is maintained at a constant level.

A first fraction of oil in the oil separator 5 returns to the one or more injection ports 11A of the stationary scroll 13A through the line 29 from the bottom of the oil separator 5. A second fraction of oil in the oil separator 5 returns to the return port 31 along with helium through the demister 7 and lines 17, 23 and 25. A third fraction of oil may be retained in the adsorber 8. In the embodiment shown in FIG. 2, the oil level in the oil sump 18 of the housing 2 is constant as oil flows out with helium through line 12 to bulk oil separator 5, and the oil level in the oil separator 5 external to the compressor 210 is depleted as the third fraction of oil is retained in the adsorber 8.

It is noted that all of the standard compressors described in the background section that have the motor in the high pressure section of the housing show the gas discharge port above the motor. Application of these compressors with standard refrigerants have a fixed amount of oil in the system that serves as a lubricant and not as a coolant. Most of the oil circulates within the compressor and collects in the sump at a level below the discharge port. FIG. 2 shows discharge port 30 below the level where oil would put a drag on the motor and above the level for oil in an application with standard refrigerants.

The terms and descriptions used herein are set forth by way of illustration only and are not meant as limitations. Those skilled in the art will recognize that many variations are possible within the spirit and scope of the invention and the embodiments described herein.

What is claimed is:

1. A helium compressor system using an unmodified scroll compressor designed for air conditioning or food storage service, comprising:

a compressor having a housing, comprising:

a scroll including an orbiting scroll and a stationary scroll, wherein the stationary scroll has one or more injection ports;

a discharge port in the housing, through which a mixture of helium at high pressure and oil is discharged;

at least one return port in the housing, which receives helium at low pressure;

an injection port in the housing, which is connected to the one or more injection ports of the stationary scroll;

a motor that has a drive shaft that drives the orbiting scroll; and a compressor oil sump located in a bottom of the housing; and an oil management system comprising:

an oil separator receiving the mixture of the helium at high pressure and the oil from the discharge port;

a first line bringing a first fraction of the oil from the oil separator to the one or more injection ports of the stationary scroll through the injection port of the housing;

one or more return lines bringing a second fraction of the oil to the at least one return port along with the helium at low pressure; and an adsorber that retains a third fraction of the oil.

2. The helium compressor system of claim 1 wherein the scroll includes an inlet that receives the helium at low pressure supplied through the at least one return port, and an outlet that discharges the helium at high pressure.

3. The helium compressor system of claim 2 wherein the housing includes a high pressure section formed above the scroll, and the helium at high pressure is discharged to the high pressure section from the outlet of the scroll.

4. The helium compressor system of claim 2 wherein the one or more injection ports of the scroll are located between the inlet and outlet of the scroll.

5. The helium compressor system of claim 1 wherein the housing includes a low pressure section below the scroll, and the one or more returns ports are connected to the low pressure section.

6. The helium compressor system of claim 1 wherein the oil separator comprises a float valve through which a portion of the second fraction of the oil flows to the one or more return lines.

7. The helium compressor system of claim 6 wherein the oil management system further comprises a demister connected between the oil separator and the adsorber, wherein another portion of the second fraction of the oil flows to the one or more return lines from the demister.

8. The helium compressor system of claim 1 wherein the oil separator is configured to maintain a constant oil level in the oil separator, and an oil level in the compressor oil sump drops as the third fraction of the oil is retained in the adsorber.

9. The helium compressor system of claim 1 wherein the oil management system further comprises an oil cooler that cools the first fraction of the oil.

10. The helium compressor system of claim 1 wherein the discharge port is located in a bottom portion of the housing below the scroll.

11. The helium compressor system of claim 1 wherein the discharge port is configured to maintain a constant oil level in the compressor oil sump, and an oil level in the oil separator drops as the third fraction of the oil is retained in the adsorber.

12. The helium compressor system of claim 1 wherein the scroll includes an inlet that is connected to the at least one return port and receives the helium at low pressure and the second fraction of the oil supplied through the at least one return port, and an outlet that discharges the helium at high pressure.

13. The helium compressor system of claim 1 further comprising a demister connected between the oil separator and the adsorber, wherein some or all of the second fraction of the oil flows to the one or more return lines from the demister.

14. An oil lubricated scroll compressor system that supplies compressed helium to one or more cryogenic expanders, comprising:

a compressor, comprising:

a scroll that compresses helium, wherein the scroll comprises an inlet to receive helium at low pressure, an outlet to discharge helium at high pressure, and one or more injection ports;

an oil sump that is located in a bottom of the compressor and contains oil to lubricate the compressor;

a discharge port through which a mixture of the helium at high pressure and the oil is discharged;

at least one return port that receives the helium at low pressure;

an injection port connected to the one or more injection ports of the scroll; and a motor that has a drive shaft that drives the scroll; and an oil management system comprising:

an oil separator that receives the mixture of the helium at high pressure and the oil from the discharge port;

a first line bringing a first fraction of the oil from the oil separator to the one or more injection ports of the scroll;

one or more return lines bringing a second fraction of the oil from the oil separator to the at least one return port along with the helium at low pressure; and an adsorber that retains a third fraction of the oil.

15. The oil lubricated scroll compressor system of claim 14 wherein the second fraction of the oil includes oil supplied through a float valve of the oil separator and oil supplied through a demister that is connected between the oil separator and the adsorber.

16. The oil lubricated scroll compressor system of claim 14 wherein the at least one return port is located between the scroll and the oil sump of the compressor.

17. The oil lubricated scroll compressor system of claim 14 wherein the oil separator is configured to maintain a constant oil level in the oil separator, and an oil level in the oil sump of the compressor drops as the third fraction of the oil is retained in the adsorber.

18. The oil lubricated scroll compressor system of claim 14 wherein the discharge port is located between the scroll and the oil sump of the compressor.

19. The oil lubricated scroll compressor system of claim 14 wherein the discharge port is configured to maintain a constant oil level in the compressor oil sump, and an oil level in the oil separator drops as the third fraction of the oil is retained in the adsorber.

20. The oil lubricated scroll compressor system of claim 14 further comprising an oil cooler that cools the first fraction of the oil.

* * * * *